United States Patent [19]

Tennant et al.

[11] Patent Number: 4,794,029

[45] Date of Patent: Dec. 27, 1988

[54] TOWEL THAT CONVERTS INTO A BAG

[76] Inventors: Lynne H. Tennant; Ashley A. Herrin, both of 244 Thirteenth St., NE., #101, Atlanta, Ga. 30309; Garrett L. Simmons, 876 Broadway, Fourth Floor, New York, N.Y. 10003

[21] Appl. No.: 18,358

[22] Filed: Feb. 24, 1987

[51] Int. Cl.[4] ..... A45C 9/00; A47G 9/00

[52] U.S. Cl. ..... 428/101; 5/417; 190/1; 383/4

[58] Field of Search ..... 2/49 R, 69; 5/417, 418, 5/419, 420; 190/1; 383/4; D6/595, 596, 603; 428/78, 79, 101, 102

[56] References Cited

U.S. PATENT DOCUMENTS

| | | | |
|---|---|---|---|
| 889,073 | 5/1908 | Walbridge | 2/49 R |
| 2,299,232 | 10/1942 | Heyser | 2/49 R |
| 2,442,293 | 5/1948 | Hudson | 2/49 R |
| 2,731,997 | 1/1956 | Muth et al. | 383/4 |
| 2,781,811 | 2/1957 | Dilar et al. | 428/52 X |
| 3,016,544 | 1/1962 | Pinkney | 2/49 R |
| 3,646,896 | 3/1972 | Derujinsky et al. | 5/419 X |
| 4,195,378 | 4/1980 | Parker | 5/419 |
| 4,278,719 | 7/1981 | Sarnecki | 428/78 |
| 4,337,812 | 7/1982 | Trinkner | 206/541 X |
| 4,669,128 | 6/1987 | Furgang | 2/69 |
| 4,703,528 | 11/1987 | Rolle | 190/2 X |
| 4,709,430 | 12/1987 | Nicoll | 5/417 |

*Primary Examiner*—Henry F. Epstein
*Attorney, Agent, or Firm*—Robert W. Fiddler

[57] ABSTRACT

A circular section of woven terry fabric, with a circular section of woven nylon fabric having precisely one-fourth the area of the circular woven terry fabric attached to the inferior plane of the circular woven terry fabric, which has four sections of woven terry fabric cut on the bias and of equal lengths and widths attached along the perimeter on both the superior and inferior planes to form a casing encompassing a cotton cord or drawstring thereby allowing conversion of the fabrics into a bag.

10 Claims, 5 Drawing Sheets

TOWEL THAT CONVERTS INTO A BAG

BRIEF SUMMARY OF THE INVENTION

It is an object of this invention to provide a circular section of woven terry fabric that when used as a towel for sunbathing requires no repositioning toward the changing angle of the sun. It is a further object of this invention to provide a cotton cord or drawstring contained in four sections of woven terry fabric casing cut on the bias and attached to the perimeter of the circular section of woven terry fabric on both the superior and inferior planes permitting the conversion of the materials into a bag. In addition, a circular section woven nylon fabric having precisely one-fourth the area of the circular woven terry fabric is attached to the inferior plane of the circular woven terry fabric, providing added support and durability to the weight-supporting, inferior portion of the bag. The circular shape of the invention to form a half-circle may also be wrapped around the human body as an absorbent, heat-retaining garment.

DETAILED DESCRIPTION

In accordance with a preferred embodiment of the invention, a towel-bag contruction is formed by a circular towel of woven terry fabric 1, four sections of woven terry fabric casing 2 cut on the bias and of equal lengths and widths, a cotton cord or drawstring 3, and a circular section of woven nylon fabric 4 having precisely one-fourth the area of the circular section of woven terry fabric 1. This construction provides a towel that when used for sunbathing requires no repositioning toward the changing angle of the sun and may also be converted into a bag for transporting various and sundry sunbathing articles, as well as used as an absorbent, heat-retaining garment.

The circular shape of the towel allows for the repositioning of the human body toward the changing angle of the sun while the towel remains stationary, thereby eliminating the need for continual repositioning of the towel as with the conventional rectangular sunbathing towel.

In addition, the towel-bag construction permits ready conversion of the circularly shaped towel into a bag (FIG. 5), a provision unavailable with a conventional rectangular sunbathing towel. Furthermore, the circular section of woven nylon fabric 4 attached equidistant to the inferior plane of the circular section of woven terry fabric 1 of the towel provides added support and durability to the weight-supporting, inferior portion of the bag.

Also, the circular shape of the towel folded to create a half-circle and utilized as a garment permits greater conformity to the human body than that of the conventional rectangular sunbathing towel. The double thickness of the fabric allows superior body heat retainment and moisture absorbency as well.

Figure 3:
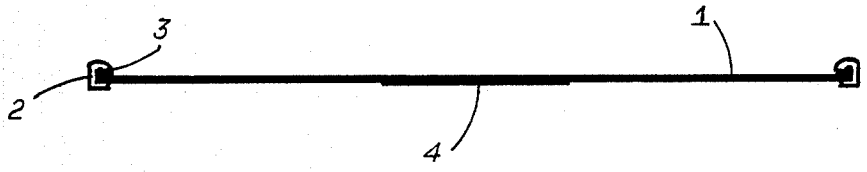
FIG. 3 Cross section of a lateral view of the invention.

In the making of the structure of this invention, four sections of woven terry fabric are cut on the bias to better conform to the arced perimeter of the circular woven terry fabric 1 measuring sixty inches in diameter. Each of the four sections of woven terry fabric casing 2, measuring forty-seven and three quarters inches by six inches, is hemmed three quarters of an inch on each of the four sides, employing twenty stitches of sewing thread per inch. One of the longer sides of each four sections of woven terry fabric casing 2 is sewn, employing twenty stitches of sewing thread per inch, from the edge one and one-half inches into the perimeter of the inferior plane of the circular section of woven terry fabric 1, leaving one and one-half inches between each section of woven terry In FIG. 3, the sections of woven terry fabric casing 2 are brought up from the inferior plane and over the perimeter of the circular terry fabric 1 to the superior plane of the same. The remaining longer sides of each section of woven terry fabric casing 2 are sewn, employing twenty stitches per inch, from the edge one and one-half inches into the perimeter of the superior plane of the circular section of woven terry fabric 1. The attached woven terry fabric casing 2 has an elevation of one and one-half inches from the inferior plane of the circular section of woven terry fabric 1.

The cotton cord or drawstring 3, one hundred and eighty-eight inches in length and one-quarter of an inch in diameter, is threaded through each of the four sections of woven terry fabric casing 2, tying the ends of the cotton cord or drawstring 3 together.

Figure 2:
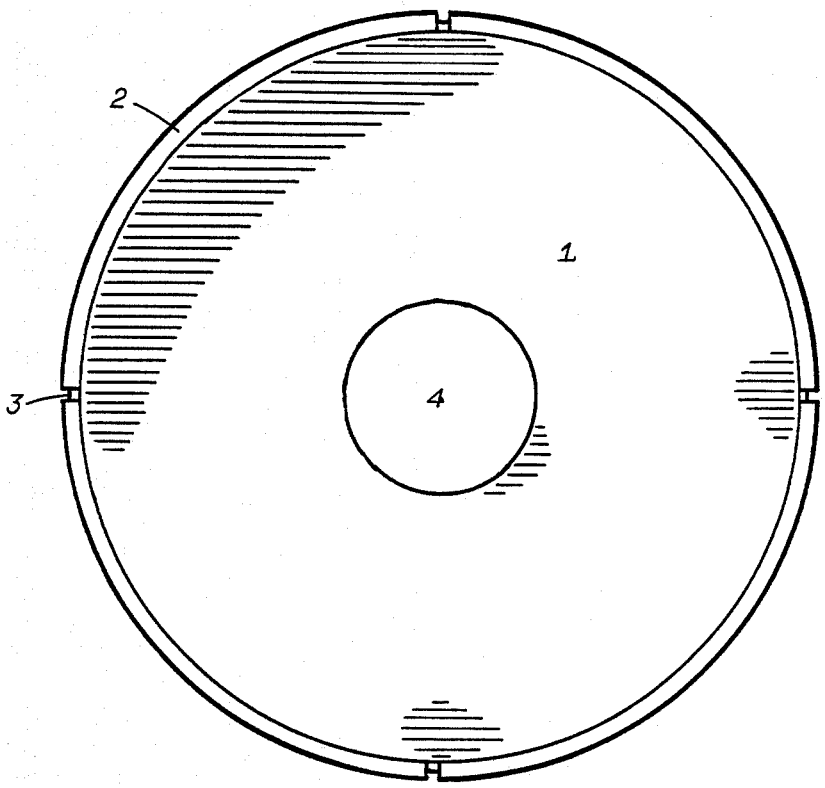
FIG. 2 An inferior perspective view of the invention showing the circular section of nylon fabric 4.

The circular section of woven nylon fabric 4 measuring fifteen and three-quarters inches, allowing for three-quarters of an inch hem around the perimeter of the same, is sewn employing twenty stitches of sewing thread per inch onto the inferior plane of the circular woven terry fabric 1 in a position equidistant to the perimeter of the same (FIG. 2).

Figure 1:
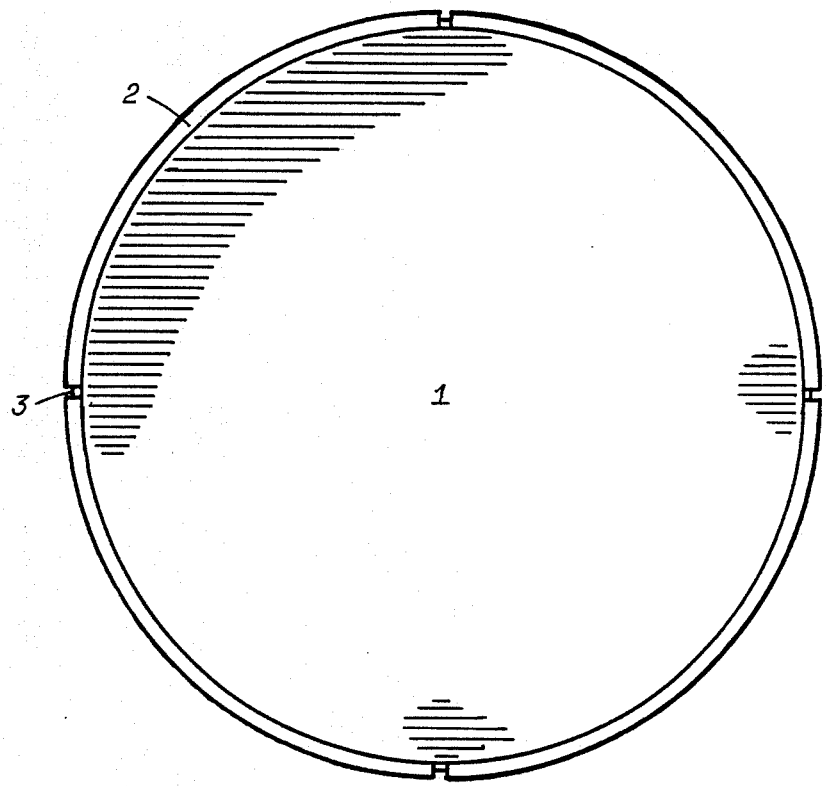
FIG. 1 A superior perspective view of the invention showing the circular section of woven terry fabric 1, the casing composed of woven terry fabric 2, and the cotton cord or drawstring 3.
Figure 4:
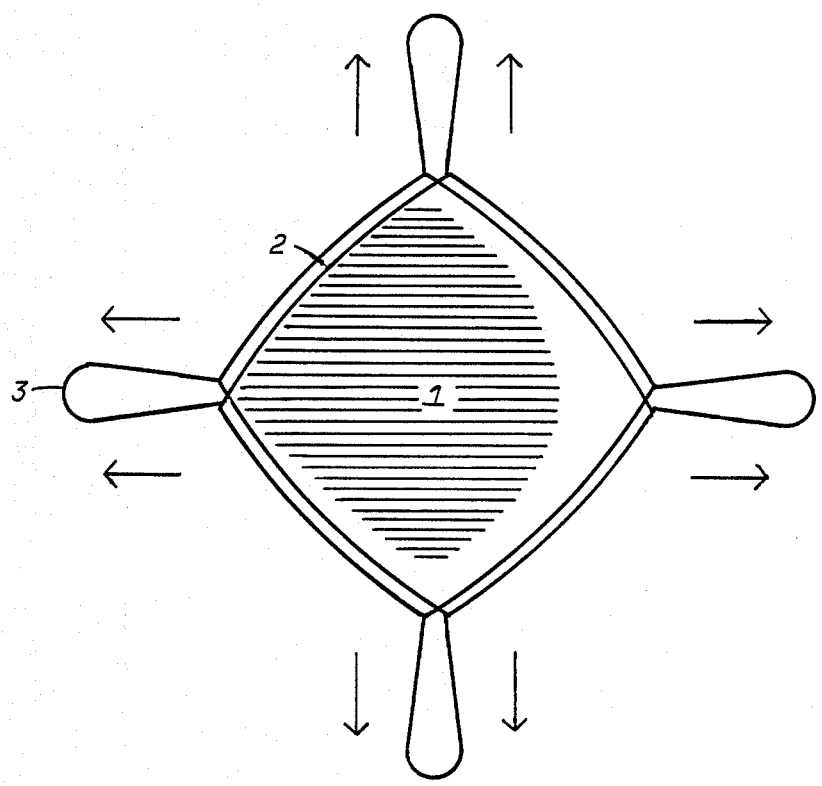
FIG. 4 A superior perspective view of the invention showing the cotton cord or drawstring 3 being extracted and pulled from the casing 2 as the casing 2 and circular woven terry fabric 1 begin to constrict and form a bag.
Figure 5:
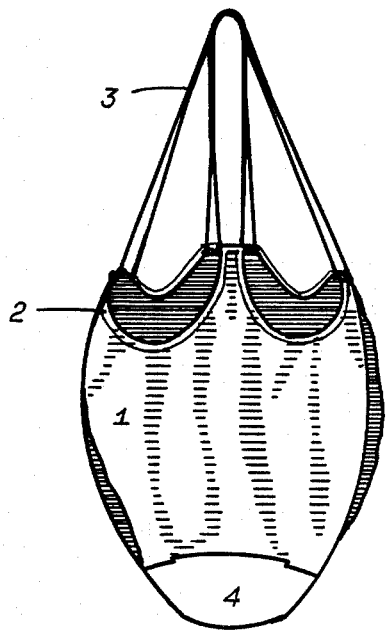
FIG. 5 An anterior perspective view of the invention showing the cotton cord or drawstring 3 fully extended from the casing 2 and the circular woven terry fabric 1 having formed a bag with the circular section of woven nylon fabric 4 supporting the inferior portion of the bag.

The transformation (FIG. 4) of the towel from the flat circular section of woven terry fabric (FIG. 1) into a bag commences as the cotton cord or drawstring 3 is extracted and pulled outwardly from each of the four openings of the woven terry fabric casing 2, as the circular woven terry fabric 1 and the woven terry fabric casing 2 constrict. Each of the four lengths of protracted cotton cord or drawstring 3 are fully extended from the woven terry fabric casing 2, raised to a vertical position and combined, having formed a bag (FIG. 5). The combined lengths of the cotton cord or drawstring 3 are clutched providing a method of transporting the bag.

What is claimed is:

1. A towel-bag construction comprising: a non-rectangular towel;

a casing formed at the perimeter of said towel;

a cord threaded through said casing; and a section of relatively non-stretchable fabric of a shape geometrically similar to that of said towel attached with its edges equidistant from the edges of said towel.

2. A towel-bag construction as set forth in claim 1 wherein said towel is circular in shape, whereby a user while sunbathing may reposition his or her body towards the changing angle of the sun while the towel remains stationary.

3. A towel-bag construction as set forth in claim 1 in which said casing is formed of the material of said towel.

4. A towel-bag construction as set forth in claim 1 in which said casing is formed of a plurality of separated parts, with said cord exposed between said parts.

5. A towel-bag construction as set forth in claim 4 in which said cord is continuous and may be drawn up to bring the edges of said towel together to form a bag.

6. A towel-bag construction as in claim 3, in which said casing is formed of at least three separated parts, with said cord extending continuously through each casing part and exposed for manual gripping at the separation between said casing parts.

7. A towel-bag construction as in claim 1 in which said section of non-stretchable fabric is formed of a woven nylon fabric, relatively non-absorbent as compared to the towel.

8. A towel-bag construction as in claim 7 in which said section of non-stretchable fabric is one quarter the area of said towel.

9. A towel-bag construction as in claim 1 in which said casing is formed of a woven fabric cut on the bias.

10. A towel-bag construction comprising: a circular towel of woven absorbent fabric; a central circular section of relatively non-absorbent fabric material of an area one quarter the area of said towel; a plurality of spaced casing sections formed along the edge of said towel; and a continuous cord extending through said casing sections.

* * * * *